United States Patent [19]

Winaver

[11] Patent Number: 4,981,079

[45] Date of Patent: Jan. 1, 1991

[54] PROJECTILE FOR THE NEUTRALIZATION OF A ZONE, NOTABLY AN AIRFIELD

[75] Inventor: André Winaver, Paris, France

[73] Assignee: Thomson-Brandt Armements, Boulogne Billancourt, France

[21] Appl. No.: 403,264

[22] Filed: Sep. 5, 1989

[30] Foreign Application Priority Data

Sep. 9, 1988 [FR] France ..... 88 11823

[51] Int. Cl.[5] ..... F42B 12/58

[52] U.S. Cl. ..... 102/393; 89/1.11; 102/382; 102/385; 102/388; 102/489

[58] Field of Search ..... 102/346, 351, 357, 400, 102/393, 394, 382, 388, 387, 385, 489, 477, 383; 89/1.11, 1.35

[56] References Cited

U.S. PATENT DOCUMENTS

| | | | |
|---|---|---|---|
| 1,289,702 | 12/1918 | Draper | 102/383 |
| 3,175,489 | 3/1965 | Reed, Jr. | 102/404 |
| 3,439,610 | 4/1969 | Myers | 102/394 |
| 4,063,515 | 12/1977 | Schneider, Jr. et al. | 102/505 |
| 4,522,356 | 6/1985 | Lair et al. | 102/489 |
| 4,715,283 | 12/1987 | Yengst | 102/384 |
| 4,831,935 | 5/1989 | Sundermeyer | 102/384 |
| 4,860,660 | 8/1989 | Synofzik et al. | 102/386 |
| 4,870,904 | 10/1989 | Picot | 102/387 |

FOREIGN PATENT DOCUMENTS

| | | | |
|---|---|---|---|
| 3127071 | 1/1983 | Fed. Rep. of Germany . | |
| 3510402 | 9/1986 | Fed. Rep. of Germany | 102/393 |
| 499064 | 1/1920 | France . | |
| 1605558 | 7/1980 | France . | |
| 2479972 | 10/1981 | France . | |
| 2541444 | 8/1984 | France . | |

*Primary Examiner*—David H. Brown

*Attorney, Agent, or Firm*—Pollock, VandeSande & Priddy

[57] ABSTRACT

The disclosed projectile has a tube forming a mortar, a munition contained in the tube, at least three deployable fins, solidly joined to the tube, and firing means triggering the ejection of the munition. During operation, when the projectile, released from an aircraft, lands on the ground for example, the fins form a pedestal in the mortar tube and, upon the command of the firing means, the munition is ejected to a certain distance from the tube.

10 Claims, 3 Drawing Sheets

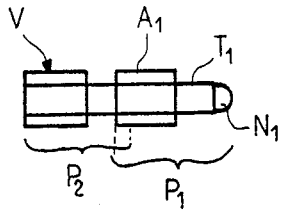
FIG_1-a
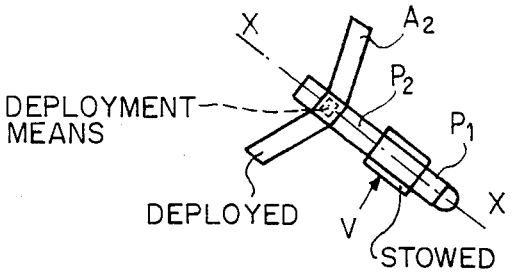
FIG_1-b
FIG_1-d
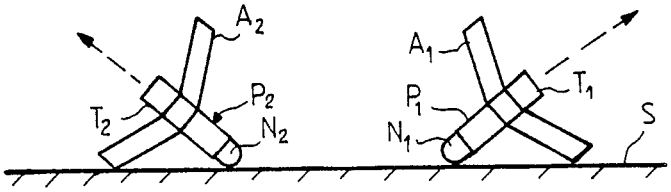

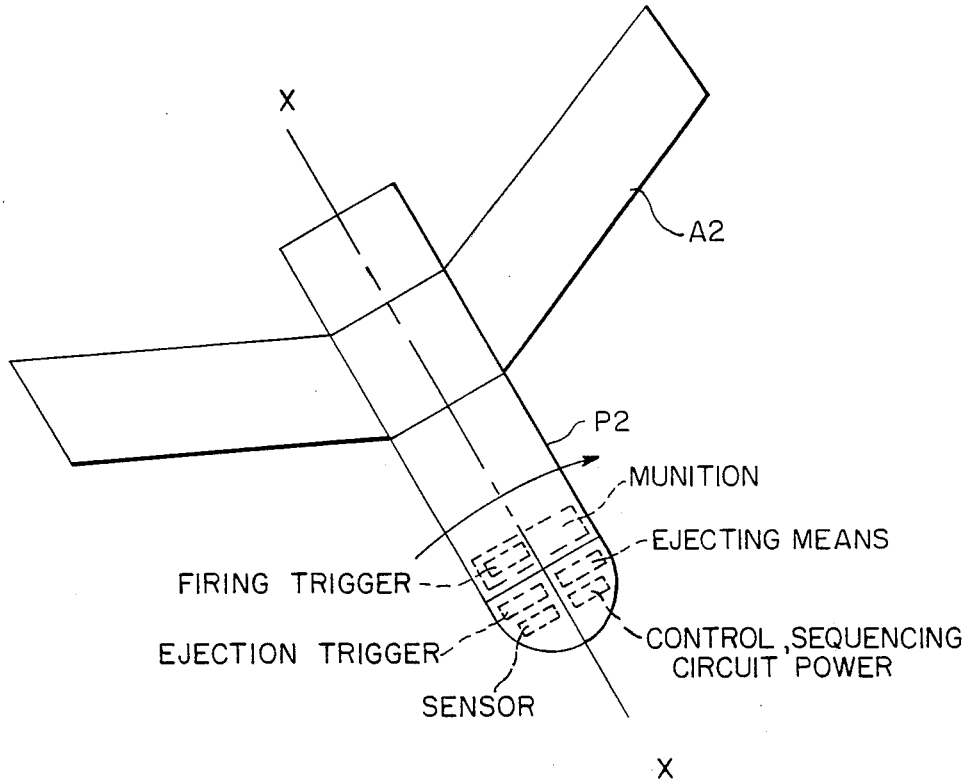
FIG. 1-c
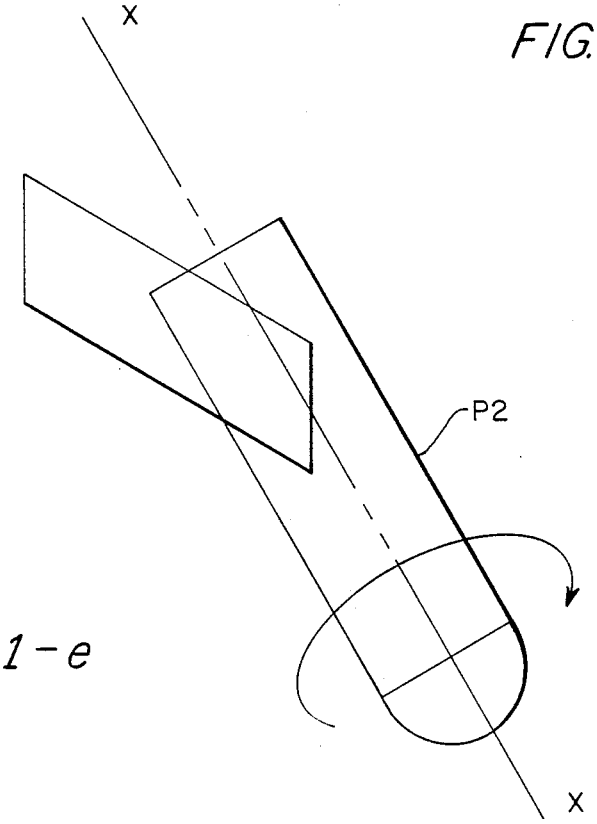
FIG. 1-e

PROJECTILE FOR THE NEUTRALIZATION OF A ZONE, NOTABLY AN AIRFIELD

BACKGROUND OF THE INVENTION

1. Field of the Invention

An object of the present invention is a projectile for the neutralization of a pre-determined zone, such as an airfield.

2. Description of the Prior Art

When it is desired, for example, to put an enemy-controlled airfield out of service, there is a known way to destroy the runways by means of specific bombs, called anti-runway bombs which, in general, partially damage the runway to prevent it from being used.

Anti-runway bombs have immediate or delayed action but, in all cases, the zone in which they are located is a strip that is fairly small and clearly defined by the passage of the aircraft or the carrier that distributes these bombs.

SUMMARY OF THE INVENTION

An object of the invention is the neutralization of a zone such as an airfield. This neutralization is done by making all or a part of the zone (for example, one or more runways or taxiways) dangerous and/or destroying it.

To this effect, a set of projectiles is distributed over the airfield, by an aircraft or a carrier for example, each of the projectiles having at least:

- a tube forming a mortar;
- a munition, such as a grenade or shell, contained in the tube;
- at least three fins, preferably deployable from the tube and, in a preferred embodiment, oriented with respect to the tube so as to give it a rotational motion during its trajectory;
- means to eject the munition after the landing of the tube, the ejection occurring, for example, immediately or with a certain delay or, alternatively, upon command from a noise sensor or proximity sensor.

At the landing, the fins form a pedestal for the mortar tube and, under the control of the ejection means, the munition is ejected to a certain distance from the tube, i.e. from the initial landing point of the projectile, in a direction that depends solely on the orientation of the tube once it is standing on the ground.

Consequently, the zone, which has been made dangerous and has, therefore, been neutralized, is no longer simply the projectile distribution zone. Furthermore, since these projectiles can be distributed outside the runways or taxiways, they are harder to locate and neutralize.

BRIEF DESCRIPTION OF THE DRAWINGS

Other objects, specific features and results of the invention will emerge from the following description, illustrated by the appended drawings wherein:

FIGS. 1*a* to 1*d* show an embodiment of the projectile according to the invention in different configurations that it successively adopts during its operation;

In these different figures, the same references refer to the same elements.

DESCRIPTION OF PREFERRED EMBODIMENTS

Figure 2:
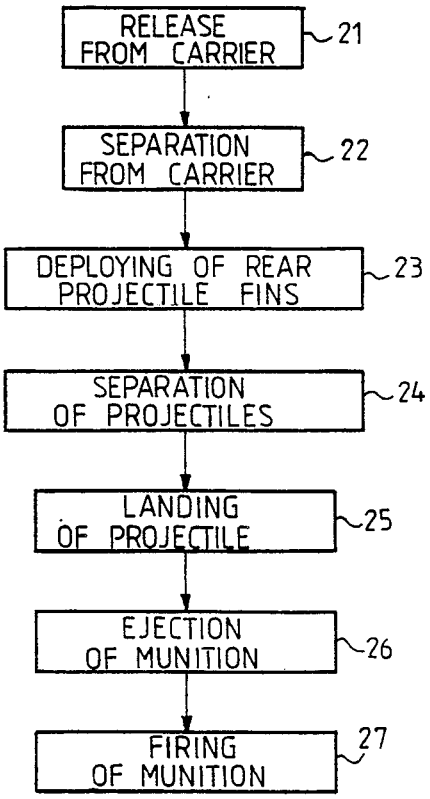
FIG. 2 shows the sequence of the steps of operation of the projectile according to the invention.

The projectile according to the invention can, for example, be distributed by being released from a carrier, such as an aircraft or a simple carrier. This is what is represented by the first step (21) of FIG. 2.

In one embodiment, the carrier does not release the projectiles separately, but releases projectile sets, each set consisting of one or more projectiles that subsequently get separated from one another as described below.

FIG. 1*a* shows a schematic view of an embodiment of a projectile set such as this.

In this example, the projectile set, marked V, consists of two projectiles $P_1$ and $P_2$ nested into each other and fixed by any known means. Each projectile has a tube-shaped body ($T_1$ for the projectile $P_1$) closed at one of its ends by a nose ($N_1$) that contains different electric and electronic sequencing, control and powering means. In the rear part (opposite the nose) of the tube ($T_1$), fins ($A_1$) are mounted. In this embodiment, the fins ($A_1$) are deployable and initially folded, and their minimum number is three. Inside the tube ($T_1$), there is a munition which is not visible in FIG. 1*a*. It is kept therein by any known means (for example, retaining clip or diaphragm) which, in addition, provides for the imperviousness of the tube.

The next step, 22 in FIG. 2, consists in separating the projectile set from the carrier, after release. This is done in a standard way, for example by means of a parachute housed in the rear of the projectile set V, the opening of which is actuated by the releasing of the projectile set.

The next step, 23 in FIG. 2, consists in deploying or unfolding the fins of that one of the projectiles located farthest to the rear of the projectile set V, namely the fins $A_2$ of the projectile $P_2$, as shown in FIG. 1*b*. These fins have a first function which is, conventionally, to stabilize the trajectory of the projectile set. Furthermore, in a preferred embodiment, the surface plane of each of the fins intersects the longitudinal axis XX of the projectile set so as to give the projectile set a rotational motion on its longitudinal axis.

The next step (24, FIG. 2) consists in the separation of the projectiles $P_1$ and $P_2$. This separation may be actuated, for example, by a chronometer device or by a proximity fuse, namely a device triggering the separation at a certain distance between the projectile set and the ground. The projectile $P_2$ then continues its trajectory towards the ground, as shown in FIG. 1*c*. At the same time, the fins of the projectile $P_1$ are deployed and this projectile continues its own trajectory towards the ground also being preferably driven by a rotational motion on its longitudinal axis. Preferably, the angle made by the surface of the fins with the longitudinal axis is different for the two projectiles, for the reasons explained hereinafter.

Should the projectile set V have more than two projectiles, this mechanism is repeated as many times as there are projectiles to be separated, starting preferably with the separation of that projectile which is farthest to the rear of the nested arrangement.

Each of the projectiles, at the end of its trajectory, reaches the ground (step 25 in FIG. 2) where it lands in such a way that the mortar tube $T_1$, $T_2$ makes a non-zero angle with the plane of the ground, with the fins effectively forming a pedestal for the tube. This is what is shown in FIG. 1*d*, where the two projectiles $P_1$ and $P_2$ are shown, settled on the ground S, the tubes $T_1$ and $T_2$ being oriented in different directions. The fact that the orientation of its fins gives the projectile a rotational motion, which is preferably different from one projectile to another, makes it possible to increase the probability of obtaining tubes oriented in different directions.

The next step (26, FIG. 2) is the ejection of the munition contained in the tube $T_1$, $T_2$. This is what is shown by an arrow (in dashes) in FIG. 1*d*. The ejection may be either instantaneous or deferred by a pre-determined period, which is preferably variable from one projectile to another, or triggered by a proximity or noise sensor. It is possible to use, for example, a sensor sensitive to certain types of noise, such as a propeller noise. These triggering means are contained in the nose $N_1$, $N_2$ of the projectile.

The last step (27, FIG. 2) consists in the firing of the munition. The munition may be, for example, of the type comprising a grenade, a shell, a mine, a mine fitted with a wire etc. The firing may be instantaneous, upon impact of the munition on the ground. It may be deferred, through triggering means of the type described above for the ejection of the munition. Or, it may be done before impact of the munition on the ground, using means of the time fuse or proximity fuse type.

Thus, with the munitions being ejected or being capable of being ejected at a certain distance from the initial landing point of the projectile, it is seen that the neutralized zone is not identical with the projectile distribution zone. Furthermore, the random orientation of the mortar tubes means that the effectively dangerous zone cannot be easily determined. Finally, the fact that the point of impact of the munition is different from that of the projectile enables a passage (runway or taxiway) to be made dangerous while the source of the danger (the mortar tube) is not on the passage in question. The mortar tube is then harder to locate and, therefore, harder to neutralize.

The above description has naturally been given as a non-restrictive example. Thus, the projectile according to the invention can be applied to the neutralization of any type of zone: an unavoidable crossing point, a zone where enemy forces are deployed etc. The projectile can be launched from the ground, the steps 21 and 22 of FIG. 2 being replaced by a launching step. All the fins or a part of them may be no longer deployable but fixed. This is simpler but entails sacrifice as regards the space factor during carriage.

What is claimed is:

1. A projectile for the neutralization of a zone, comprising:

a tube forming a mortar;

a munition placed in the tube;

at least three fins, connected to the tube, forming a pedestal for the tube when it lands on the ground;

the surface plane of each of the fins intersecting the longitudinal axis of the tube, thus giving the tube a rotational motion about its longitudinal axis during its trajectory; and means to eject the munition outside the tube when said tube lands.

2. A projectile according to claim 1 together with means for deploying the fins from a stowed position.

3. A projectile according to claim 1, wherein the munition is a grenade, a shell, or a mine.

4. A projectile for the neutralization of a zone, comprising at least two projectiles according to claim 1, the two projectiles being nested together during launching, and then separated from each other on the trajectory of the projectile.

5. A projectile according to claim 1, wherein the munition includes means to trigger its firing.

6. A projectile according to claim 5, wherein the munition firing trigger means including means to fire the munition before its impact on the ground.

7. A projectile according to claim 5, wherein the munition firing trigger means including means to fire the munition after its impact on the ground.

8. A projectile according to claim 1 wherein the fins are placed at one end of the tube forming the rear of the projectile, the tube being closed at its other end forming the nose of the projectile, means for the sequencing, control and powering of the projectile being placed in the nose.

9. A projectile according to claim 8, wherein the means placed in the nose of the projectile include means to trigger the ejection of the munition, the triggering being deferred by a pre-determined duration.

10. A projectile according to claim 9, wherein the ejection trigger means placed in the nose of the projectile comprises a proximity sensor or noise sensor.

* * * * *